United States Patent [19]

Magidson

[11] 4,319,567

[45] Mar. 16, 1982

[54] DISPOSABLE FACE MASK

[75] Inventor: Mark Magidson, Los Angeles, Calif.

[73] Assignee: Moldex/Metric Products, Inc., Culver City, Calif.

[21] Appl. No.: 166,315

[22] Filed: Jul. 7, 1980

[51] Int. Cl.[3] ..... A62B 7/10

[52] U.S. Cl. ..... 128/206.19; 128/206.24

[58] Field of Search ..... 128/206.19, 139, 206.24; 264/324

[56] References Cited

U.S. PATENT DOCUMENTS 3,220,409 11/1965 Liloia et al. ..... 128/206.19

3,974,829 8/1976 Tate, Jr. ..... 128/139

FOREIGN PATENT DOCUMENTS 438863 11/1935 United Kingdom ..... 128/206.19

*Primary Examiner*—Henry J. Recla

*Attorney, Agent, or Firm*—Charles H. Schwartz; Ellsworth R. Roston

[57] ABSTRACT

A face mask formed by a plurality of fibers and generally having a cup shape to fit over the mouth and nose of a wearer and for filtering the air passing through the fibers, including, a nose bridge portion, nose pad portions to either side of the nose bridge portion to fit against the sides of the nose and against the cheekbones of the wearer, and a central portion of the face mask below the nose bridge portion and the nose pad portions and with the fibers of the nose pad portions more lightly compacted than the fibers in at least the central portion of the face mask to have the nose pad portions thicker and more flexible than at least the central portion of the face mask for providing a seal against the sides of the nose and the cheekbones for preventing the passage of air between the mask and the face of the wearer.

19 Claims, 7 Drawing Figures

Fig. 5
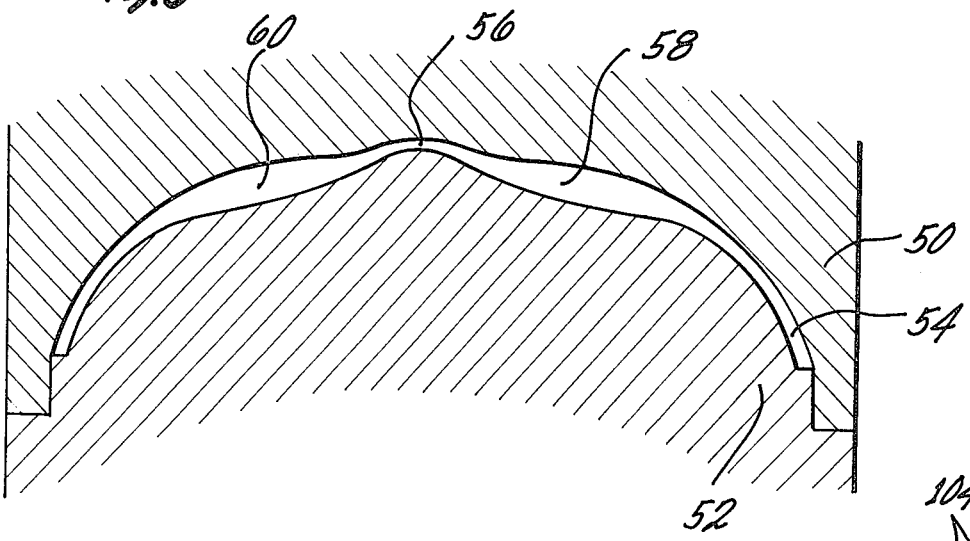
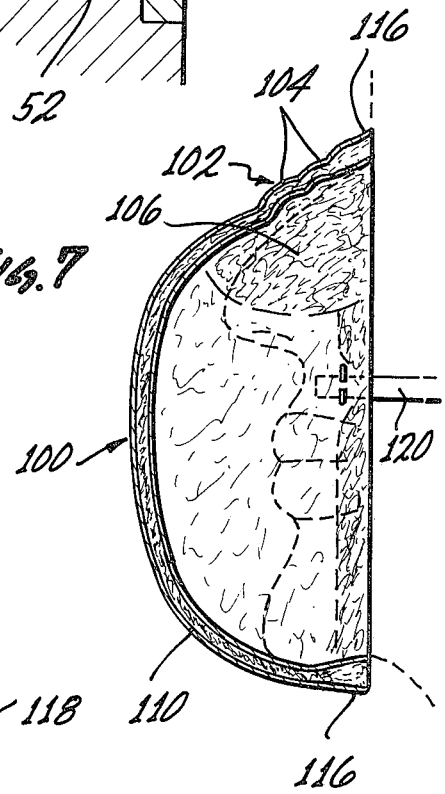
Fig. 7
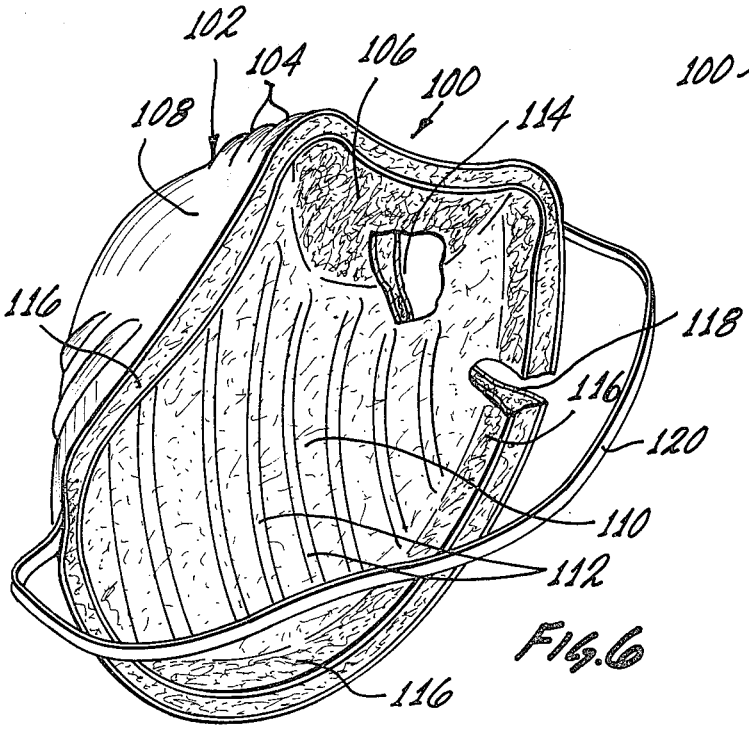
Fig. 6

DISPOSABLE FACE MASK

The present invention is directed to a face mask and as an example to a face mask which may be manufactured inexpensively and may therefore be disposable. Specifically, the present invention is directed to a molded face mask which has a particular physical configuration for providing for a better seal between portions of the face mask and the face of the wearer of the face mask to prevent air passing between portions of the face mask and face of the wearer.

The face mask of the present invention may be used in a variety of different applications. For example, such face masks may be sterilized and then used as surgical masks and with the masks discarded after a single use. Other uses of the face mask of the present invention may be for various industrial applications so as to filter out particles of dust or dirt. In such industrial environments, the mask may be used more than once and then discarded when the mask no longer provides for adequate filtering.

In the prior art, disposable face masks have been used and with such masks molded from a sheet or batt of fibers by placing the fiber sheet or batt between dies and with the application of heat and pressure provided for molding the mask to a desired configuration. Reference is made, for example, to U.S. Pat. No. 3,220,409 issued Nov. 30, 1965 and listing Liloia and Bird as the inventors and which patent describes a prior art type of molded face mask.

During the molding of the face mask described in U.S. Pat. No. 3,220,409, portions of the mask are tightly compacted or compressed relative to other portions of the mask. Specifically, in the above-referenced patent, the fibers are tightly compacted or compressed in the nose area and along the valleys of flutes in the mask and in a rim area. The use of these tightly-compacted areas provides for a mask which has substantial structural strength so as to maintain its molded shape.

With the face mask of the present invention, portions of the mask have the fibers more lightly compacted relative to other portions of the mask. However, with the face mask of the present invention, the portions of the mask which are lightly compacted are substantially opposite to the lightly compacted portions referred to in the above-referenced patent. In addition, although the present invention has portions that are more lightly compacted than other portions, the portions of the face mask which are more tightly compacted still allow for a substantial passage of air through the fibers so that the mask is comfortable to wear and yet provides for the desired filtering.

In particular, in a first embodiment of a face mask of the present invention, lightly-compacted portions of the mask are provided in the areas corresponding to the sides of the bridge of the nose and along the cheekbone. These more lightly-compacted nose pad portions are softer, more resilient and also thicker than other portions of the face mask. These more lightly-compacted nose pad portions therefore tend to lie against the side of the nose and against the cheekbones and thereby provides for a good edge seal for the face mask in these particular areas of the face and for different facial configurations for different wearers of the mask. These particular areas of the face are of particular importance since with prior art face masks exhaled air would tend to leak out of the face mask around the sides of the nose and over the cheekbones and up toward the eyes. Additionally if the person wearing the face mask also wears eyeglasses then the leaked air along the sides of the nose and cheekbones would tend to fog up the eyeglasses. With the face mask of the present invention, a better seal is provided along the sides of the nose and across the cheekbones thereby greatly reducing the leakage of air from those positions.

In a second embodiment of a face mask of the present invention, the face mask may have more lightly-compacted pad portions extending around the entire periphery of the face mask in addition to the portions of the face mask conforming to the sides of the nose and cheekbones. The use of the more lightly compacted edge pad portions extending around the periphery of the face mask again provides for these portions being more flexible and thicker so that the peripheral edge of the face mask will conform more closely to the configuration of the wearer of the face mask. The edge pad portion will tend to prevent the leakage of air between the peripheral edge of the mask and the wearer's face and thereby provide for a more efficient and reliable face mask.

A clearer understanding of the invention will be had with reference to the following description and drawings wherein FIG. 1 illustrates a back perspective view of a first embodiment of a face mask constructed in accordance with the teachings of the present invention;

FIG. 5 illustrates a pair of dies used to mold the first embodiment of the face mask of the present invention;

FIG. 6 illustrates a back perspective view of a second embodiment of a face mask of the present invention; and FIG. 7 illustrates a side cross-sectional view of the second embodiment of the face mask shown in position against the face of the wearer.

Figure 1:
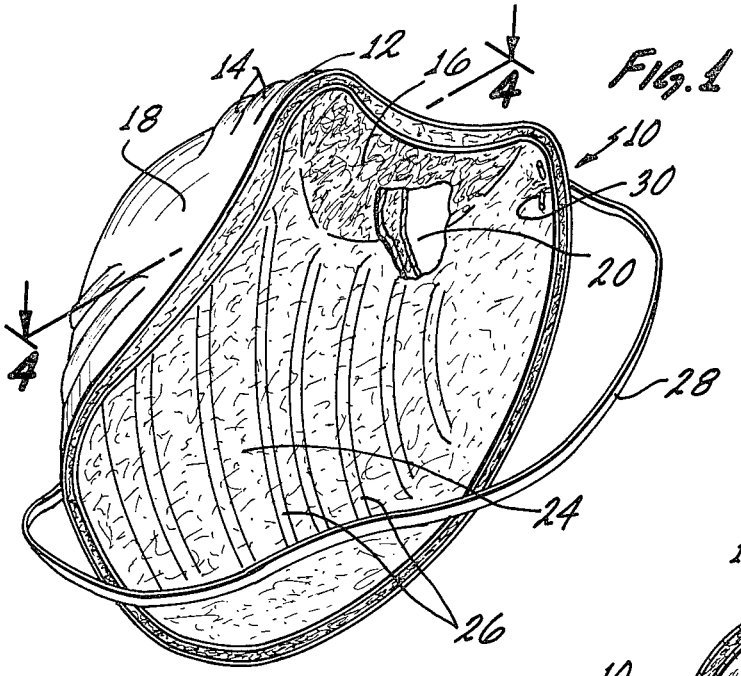

FIG. 1 illustrates a first embodiment of a face mask 10 of the present invention and with the face mask 10 molded to a generally cup shaped configuration. The face mask 10 includes a nose bridge portion 12 to fit over the bridge of the nose. The nose bridge portion is molded to include a number of ridges 14 extending across the nose bridge. The ridges 14 provide stiffening in the bridge portion 12 so as to provide shape retention for the face mask. During the molding of the face mask the peaks and valleys of the ridges 14 are compacted to substantially the same degree.

Extending to either side of the nose bridge portion 12 are lightly-compacted nose pad portions 16 and 18 which, as shown in partially broken away portion 20 in FIG. 1, are thicker than adjacent portions of the face mask. The thicker, more lightly-compacted nose pad portions 16 and 18 are more flexible and resilient than the adjacent portions and tend to lie against the sides of the nose and the cheekbones to provide for an efficient seal against the face. This is more clearly shown in FIG. 2 by partially broken away section 22 which illustrates how the more lightly-compacted nose pad portions 16 and 18 lie against the sides of the nose and the cheekbones of the face of the wearer. Partially broken away section 22 is shown to be broken away lower on one side than the other, but it is to be appreciated that each lightly-compacted portion 16 or 18 provide for sealing both against the side of the nose and the cheekbone.

Below the more lightly-compacted nose pad portions 16 and 18 and the more tightly-compacted area 12 is a central portion 24 of the face mask 10. The central portion 24 of the face mask 10 includes a plurality of substantially parallel ridges 26 which are formed during the molding of the mask and provide for a stiffening of the central portion 24 of the mask to produce a desired shape retention for the mask. However, the entire central portion 24 of the mask including both the peaks and valleys of the ridges 26 are compacted to substantially the same degree. Also the central portion may be compacted to substantially the same degree as the nose bridge portion 12 of the face mask.

Although the central portion 24 of the face mask 10 is more tightly-compacted than the nose pad portions 16 and 18, the central portion 24 is not so tightly compacted so as to restrict a relatively free passage of air so that the breathing of the wearer of the mask is not adversely affected. The mask may actually be held onto the face of the wearer using an elastic band 28 which band is attached to the mask by staples 30.

Figure 3:
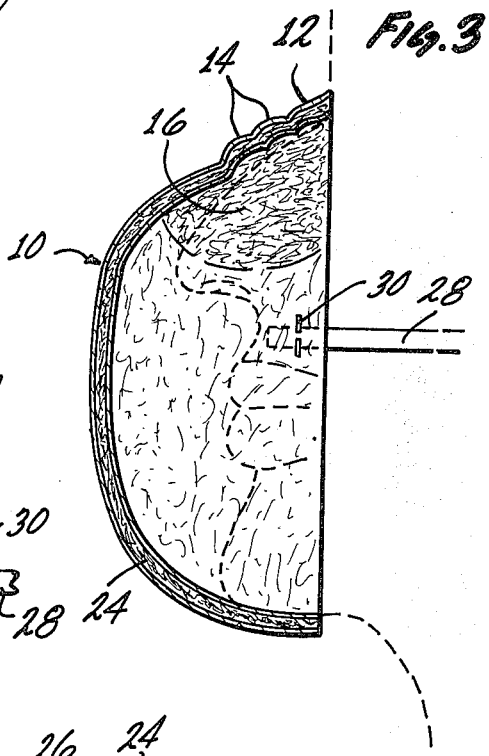
FIG. 3 illustrates a side cross-sectional view of the first embodiment of the face mask showing the mask in position against the face of the wearer.
Figure 2:
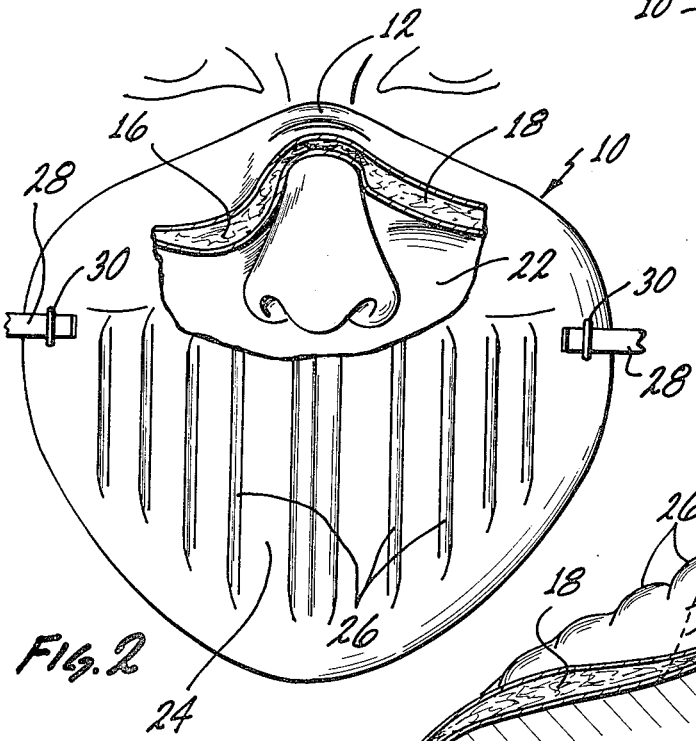
FIG. 2 illustrates a front view of the first embodiment of the face mask of the present invention and with a partially broken away section showing the sealing of portions of the face mask to the sides of the nose and cheekbones of a wearer.
Figure 4:
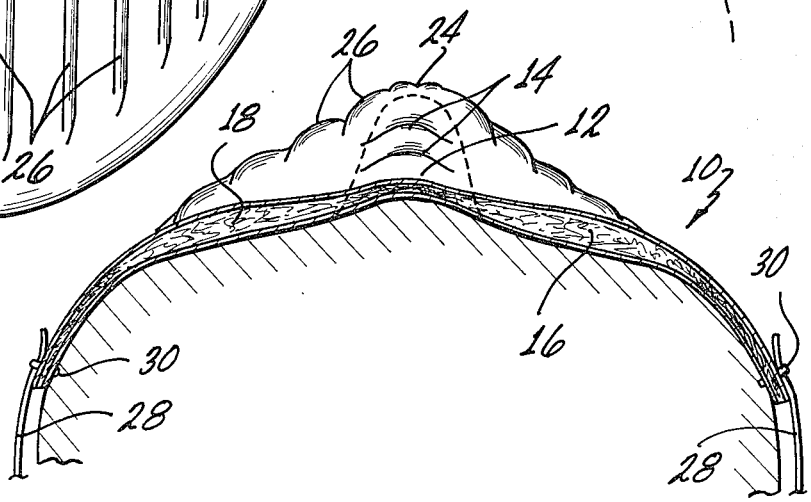
FIG. 4 illustrates a top cross-sectional of the first embodiment of the face mask taken along line 4—4 of FIG. 1.

As can be seen specifically in FIGS. 2 and 3, the peripheral edge portions of the mask 10 lie against the face of the wearer extending on both sides from an upper position against the bridge of the nose to a lower position under the chin. The use of the lightly-compacted nose pad portions 16 and 18 provide for these more resilient and thicker portions conforming to the sides of the nose and the cheekbones as shown in FIGS. 2 and 3 and provide for a seal to restrict the passage of air through these portions 16 and 18. The nose pad portions 16 and 18 therefore prevent air, which is exhaled from the wearer, escaping from the sides of the nose and around the cheekbones. The exhaled air can be uncomfortable to a wearer of the face mask and can fog eyeglasses.

FIG. 5 illustrates a cross-sectional view of a two piece die mold which may be used to form the face mask of the present invention. The die mold includes two members 50 and 52 and with the two members spaced from each other to form a cup shaped cavity so as to produce the face mask 10 shown in FIGS. 1 through 4. As can be seen in FIG. 5, the mold includes spaced portions 54 and 56 which have a particular spacing and spaced portions 58 and 60 which have a spacing of a greater dimension than the spaced portions 54 and 56. The spaced portions 58 and 60 provide for the nose pad portions 16 and 18 of the mask 10 as shown in FIGS. 1 through 4 to be thicker and more lightly-compacted than the remaining portions of the face mask.

In general, a face mask such as the face mask 10 shown in FIGS. 1 through 4 is formed by placing a sheet or batt of non-woven fiber material, having a substantially uniform thickness between the die members 50 and 52 and with the die members brought toward each other to the position shown in FIG. 5 while at the same time heating the die members so as to form the unitary face mask by compression and heat. It is to be appreciated that various materials may be used such as polyester material and other materials of the type used in the molding art. As an example, reference is made to the Liloia et al. Patent No. 3,220,409 referred to above for other types of materials.

FIGS. 6 and 7 illustrate a second embodiment of the invention and specifically illustrate a face mask 100 including a nose bridge portion 102 having a plurality of ridges 104. To either side of the nose bridge 102 are nose pad portions 106 and 108 which have fibers that are less tightly compacted than the fibers in the nose bridge. Additionally, a central portion 110 of the mask 100 extends below the nose bridge 102 and the portions 106 and 108 and the central portion 110 includes a plurality of parallel ridges 112. The central portion 110 is also more tightly compacted than the nose pad portions 106 and 108.

The second embodiment of the face mask of the present invention also has the peaks and valleys of the ridges 104 and 112 compacted to substantially the same degree. The use of the ridges provides for some stiffening so as to provide for a desired shape retention for the face mask without unduly restricting the flow of air through the face mask. The nose pad portions 106 and 108 provide for a better sealing along the sides of the nose and across the cheekbones than prior art face masks. Portions 106 and 108 form nose pads to fill in the depression on the sides of the nose because of the greater flexibility and thickness of these nose pad portions. The portions 106 and 108 are thicker and more flexible because they contain fibers that are more lightly compacted than central portion 110. The difference in the thickness of the portions 106 and 108 relative to the portion 110 is shown in the partially broken away section 114.

The second embodiment of the invention shown in FIGS. 6 and 7 additionally include a peripheral edge portion 116 extending completely around the periphery of the face mask 100. The peripheral edge portion 116 contains fibers which are more lightly compacted than the central portion 110 of the face mask. As shown in the partially cut away section 118, the peripheral edge portion 116 is thicker than the portion 110 to therefore provide for an edge pad which extends completely around the periphery.

The edge pad 116 provides for a better sealing around the edge of the face mask to prevent the passage of air between the edge of the face mask and the wearer's face. The use of the edge pad portion 116 allows for the face mask to more closely conform to the conformation of the face of the wearer since the portion 116 would generally be more flexible and thicker than the central portion 110 of the face mask. An elastic band 120 would be used to maintain the face mask in position against the face of the wearer.

The present invention therefore provides for particular portions of a face mask having fibers which are more lightly compacted so that these portions are thicker yet more flexible so as to allow these portions to conform to the conformation of the face of the wearer. Specifically, these more lightly-compacted portions may be to either side of the nose bridge portion of the face mask so as to form nose pads to seal the face mask along the sides of the nose and across the cheekbones. Additionally, these more lightly compacted portions may form a peripheral edge pad around the periphery of the face mask.

Although the invention has been described with reference to particular embodiments, it is to be appreciated that various adaptations and modifications may be made and the invention is only to be limited by the appended claims.

I claim:

1. A face mask formed by a blank piece of material composed of a plurality of fibers having a substantially constant thickness throughout and di-molded into a generally cup-shaped configuration to fit over the mouth and nose of a wearer and for filtering the air passing through the fibers, including, a nose bridge portion, nose pad portions to either side of the nose bridge portion to fit against the sides of the nose and against the cheekbones of the wearer, and a central portion of the face mask below the nose bridge portion and the nose pad portions and with the fibers of the nose pad portions more lightly compacted during molding and thereby having a greater thickness than the fibers in at least the central portion of the face mask to have the nose pad portions thicker and more flexible than at least the central portion of the face mask for providing a seal against the sides of the nose and the cheekbones for preventing the passage of air between the mask and the face of the wearer.

2. The face mask of claim 1 wherein the nose pad portions are also more lightly compacted than the nose bridge portion.

3. The face mask of claim 1 wherein the nose bridge portion includes ridges extending across the nose bridge portion for providing shape retention for the face mask.

4. The face mask of claim 3 wherein the ridges include peaks and valleys and wherein the fibers forming the peaks and valleys of the ridges are compacted to substantially the same degree.

5. The face mask of claim 1 wherein the central portion of the face mask including ridges extending along the central portion for providing shape retention for the face mask.

6. The face mask of claim 5 wherein the ridges include peaks and valleys and wherein the fibers forming the peaks and valleys of the ridges are compacted to substantially the same degree.

7. The face mask of claim 1 additionally including a peripheral edge pad portion extending around the periphery of the face mask and with the fibers of the peripheral edge pad portion more lightly composed than the fibers in at least the central portion of the face mask to have the peripheral edge pad portion thicker and more flexible than at least the central portion of the face mask for providing a seal around the peripheral edge of the face mask for preventing the passage of air between the mask and the face of the wearer.

8. A face mask for filtering air to a wearer, including, a blank piece of material composed of a plurality of non-woven fibers having a substantially constant thickness throughout and die-molded into a generally cup-shaped configuration for fitting over the mouth and nose of the wearer and with the molded cup-shaped configuration including a nose bridge portion for laying along the bridge of the nose of the wearer, nose pad portions lying to either side of the nose bridge portion for fitting against the sides of the nose and cheekbones of the wearer, and a central portion lying below the nose bridge and nose pad portions and with the fibers of the nose pad portions more lightly compacted during molding and thereby having a greater thickness than the fibers of the nose bridge and central portions for providing sealing of the face mask along the sides of the nose and the cheekbones of the wearer.

9. The face mask of claim 8 wherein the nose bridge portion includes ridges extending across the nose bridge portion for providing shape retention for the nose bridge portion of the face mask.

10. The face mask of claim 9 wherein the ridges include peaks and valleys and wherein the molded fibers forming the peaks and valleys of the ridges are compacted to substantially the same degree.

11. The face mask of claim 8 wherein the central portion of the face mask including ridges extending along the central portion for providing shape retention for the central portion of the face mask.

12. The face mask of claim 11 wherein the ridges include peaks and valleys and wherein the molded fibers forming the peaks and valleys of the ridges are compacted to substantially the same degree.

13. The face mask of claim 8 additionally including a peripheral edge pad portion extending around the periphery of the face mask and with the molded fibers of the peripheral edge pad portion more lightly compacted than the fibers in at least the central portion of the face mask for providing sealing around the peripheral edge of the face mask.

14. A face mask for filtering air to a wearer, including, a blank piece of material composed of a plurality of non-woven fibers having a substantially constant thickness throughout and die-molded into a generally cup-shaped configuration for fitting over the mouth and nose of the wearer and with the cup-shaped configuration including a nose bridge portion for laying along the bridge of the nose of the wearer, nose pad portions lying to either side of the nose bridge portion for fitting against the sides of the nose and cheekbones of the wearer, a central portion lying below the nose bridge and nose pad portions, and a peripheral edge pad portion extending around the periphery of the face mask and with the fibers of the edge pad portion more lightly compacted during molding and thereby having a greater thickness than the fibers of at least the central portion for providing sealing of the face mask around the edge of the face mask.

15. The face mask of claim 14 wherein the nose pad portions are also more lightly compacted than the central portion.

16. The face mask of claim 14 wherein the nose bridge portion includes ridges extending across the nose bridge portion for providing shape retention for the nose bridge portion of the face mask.

17. The face mask of claim 16 wherein the ridges include peaks and valleys and wherein the molded fibers forming the peaks and valleys of the ridges are compacted to substantially the same degree.

18. The face mask of claim 14 wherein the central portion of the face mask including ridges extending along the central portion for providing shape retention for the central portion of the face mask.

19. The face mask of claim 18 wherein the ridges include peaks and valleys and wherein the molded fibers forming the peaks and valleys of the ridges are compacted to substantially the same degree.

* * * * *